US005882099A

United States Patent [19]

Salice

[11] Patent Number: 5,882,099

[45] Date of Patent: Mar. 16, 1999

[54] RETAINING FASTENING FOR A FLAP HINGED AROUND A HORIZONTAL SWIVEL AXIS TO A TOP PANEL OF A CUPBOARD

[75] Inventor: Luciano Salice, Carimate, Italy

[73] Assignee: Arturo Salice S.p.A., Novedrate, Italy

[21] Appl. No.: 813,600

[22] Filed: Mar. 7, 1997

[30] Foreign Application Priority Data

Mar. 8, 1996 [DE] Germany ..... 296 04 364 U

[51] Int. Cl.[6] ..... A47B 88/00

[52] U.S. Cl. ..... 312/328; 312/319.2; 160/207

[58] Field of Search ..... 312/328, 327, 312/326, 329, 325, 322, 319.2; 160/199, 207, 189, 190; 49/339, 346

[56] References Cited

U.S. PATENT DOCUMENTS

| | | | |
|---|---|---|---|
| 654,501 | 7/1900 | Wilson | 312/319.2 X |
| 1,994,785 | 3/1935 | Premo | 160/207 |
| 2,758,900 | 8/1956 | Marchand | 312/328 |
| 2,849,270 | 8/1958 | Warnock | 312/328 |
| 3,493,033 | 2/1970 | McGirr . | |
| 3,698,464 | 10/1972 | Scheitel | 160/207 X |
| 4,452,015 | 6/1984 | Jacques et al. . | |
| 5,215,366 | 6/1993 | Givens | 312/319.2 X |
| 5,538,064 | 7/1996 | Salice | 160/199 X |
| 5,622,414 | 4/1997 | Artwohl et al. | 312/328 X |
| 5,639,149 | 6/1997 | Grassmuck | 312/319.2 X |

FOREIGN PATENT DOCUMENTS

| | | | |
|---|---|---|---|
| 2001191 | 7/1971 | Germany | 160/207 |
| 2830192 | 1/1979 | Germany | 160/207 |
| 3343903 | 6/1985 | Germany . | |
| 3808585 | 9/1989 | Germany . | |
| 3914103 | 10/1990 | Germany . | |
| 4106018 | 8/1992 | Germany . | |
| 171296 | 8/1972 | Hungary . | |
| 205191 | 11/1991 | Hungary . | |
| 0630437 | 6/1982 | Switzerland | 312/328 |

*Primary Examiner*—Peter M. Cuomo
*Assistant Examiner*—Hanh V. Tran
*Attorney, Agent, or Firm*—Dilworth & Barrese

[57] ABSTRACT

The invention relates to a retaining fastening for a flap pivotable around a horizontal swivel axis hinged to a top panel of a cupboard and having a lever pivotably connectable to a body part of the cupboard. A free end of the lever is guided in a rail which can be fixed to an inside of the flap at right angles to the swivel axis. The lever is acted upon by a spring-loaded device preferably having a rod which can be travelled into or out of a spring housing by pneumatic or elastic force.

In accordance with the invention, the lever is a two-armed bent lever (8) whose swivel axis (7) is situated between the lever arms (9, 10), whose longer lever arm (10) is guided in the rail (17) and onto whose shorter lever arm (9) extending into the inside of the cupboard in the closed state of the flap (16, 32), one end of the spring-loaded device (5, 12) is hinged with other end being pivotably connected to the furniture body.

21 Claims, 8 Drawing Sheets

RETAINING FASTENING FOR A FLAP HINGED AROUND A HORIZONTAL SWIVEL AXIS TO A TOP PANEL OF A CUPBOARD

BACKGROUND OF THE INVENTION

The invention relates to a retaining fastening for a flap pivotable around a horizontal swivel axis hinged to a top panel of a cupboard comprising a lever pivotably connectable to the body part of the cupboard, said lever's free end being guided in a rail which can be fixed to the inside of the flap at right angles to the swivel axis and said lever being acted up by a spring-loaded means preferably comprising a rod which can be travelled into or out of a spring housing by pneumatic or elastic force.

In a retaining fastening of this type known from utility model DE-GM 77 05 285 the end of the rod guided in the spring housing is pivotably connected to the extreme end section of the lever, this pivotable connection and the bearings of the lever and of the spring housing forming the comer points of a triangle on one side panel of the body part. As flaps provided with retaining fastenings are normally positioned at the user's head height, the flap provided with the known retaining fastening can swivel out in a dangerous manner with the support of the spring force so that there is a risk of injury for the user.

A retaining fastening for a flap is known from the German published application DE-OS 26 48 085 which comprises on the one hand a guide whose one end is pivotably connected to the upper edge section of the flap and whose other end is pivotably connected at a recessed point to the top side of the cupboard and on the other hand a lever arm hinged under a spring load with one end to a side panel, the other end of which lever arm is pivotably connected to the flap at a distance to the hinge position of the guide so that the flap is connected to the cupboard body via four hinges through the guide and the lever arm and thus can be pivoted out of its vertical closed position into an open position in which it is located diagonally above the body part. Apart from the complicated pivot mechanism, when the flap is hinged with this known retaining fastening, there must still be sufficient room above the cupboard to permit the flap to be pivoted into its open position.

From the German published application DE-OS 36 05 637 a retaining fastening for a flap is known in which the flap on the one hand is guided in a movable manner by a guide with the upper part of the cupboard in its middle section and on the other hand by two guides in lateral guide rails of the side panels of the body part with its lower section so that the flap can be pivoted outwards with its upper end. This retaining fastening also comprises a complicated hinge system with a weight compensation additionally needing to be provided for the flap pivoting outward over the head of the user.

SUMMARY OF THE INVENTION

The object of the invention is to provide a retaining fastening of the type first mentioned which can be mounted in a space-saving manner and which presses the flap into the open position and holds it there only after pivoting through a certain opening angle.

This object is solved in accordance with the invention with a retaining fastening of the type first mentioned in that the lever comprises a two-armed bent lever whose swivel axis is situated between the lever arms, whose longer lever arm is guided in the rail and onto whose shorter lever arm pointing into the inside of the cupboard in the closed state of the flap one end of the spring-loaded means is hinged whose other end is pivotably connected to the furniture body.

The retaining fastening in accordance with the invention can be mounted in a space-saving manner in the upper section of the body part of the cupboard without any projecting parts coming irritatingly into use which impair access to the cupboard or the storage area. Due to the characteristics of the rod guided in the spring housing which rod is, in extending the shorter lever arm pointing into the inside of the cupboard, hinged to this, the spring-loaded means does not initially exert any great moment on the flap which pivots it into the open position so that any undesired opening is avoided.

Preferably, the two lever arms of the bent lever enclose an oblique angle with the line of action of the spring force running above the swivel axis of the bent lever with the flap closed so that in the closed position of the flap the spring-loaded means exerts a moment acting in the direction of closure on it by which moment the flap is held in its closed position and which moment must first be overcome in opening the flap before the spring-loaded means exerts a moment acting in the opening direction on the shorter lever arm after passing through the dead point position.

The longer lever arm is appropriately adjustable in its length so the it can be adapted easily and quickly to different lengths of the flaps.

In accordance with a preferred embodiment it is provided that the spring housing and the bent lever are pivoted between upwardly projecting limbs of a fastening plate. The fastening plate can then either be fastened in the middle section or adjoining a side panel to the top panel of the body part. It is naturally also possible to design a fastening plate in such a way that the spring housing and the bent lever can be fastened to a side panel.

Appropriately, a detent pin for the bent lever is mounted between the limbs above the bearing axis of the bent lever. This detent pin limits the pivot angle and thus relieves the hinges connecting the flap with the top panel.

In a further embodiment of the invention it is provided that the detent pin is pivoted and possesses an eccentric shaft. This embodiment simplifies the assembly of the retaining fastening as the spring casing can be mounted with a rod travelled out to the stop with a corresponding turn of the eccentric shaft.

The retaining fastening in accordance with the invention is also particularly suitable as a lifting means for a two-wing folding flap.

A lifting means for a two-wing flap is known from a company brochure of the Italian company of CEAM which comprises a bent lever on whose shorter arm the rod of a spring housing is hinged and on whose longer arm a sleeve is guided which can be extended in the manner of a telescope, the front end of said sleeve being pivotably connected to the lower wing of the two-wing flap. This known retaining fastening impairs free access to the inside of the cupboard.

In accordance with a particularly preferred embodiment it is therefore provided that the flap of the upper wing is a two-wing folding flap whose lower wing is hinged to a support part guided in a guiding rail hinged to the side panel of the body part. The characteristics of the spring-loaded means can be selected in such a way that the two-wing folding flap swivels automatically under spring force into the open position after a short pulling out and lifting of the lower wing by means of a handle.

In accordance with another preferred embodiment it is provided that the support part is made from an elongated slide part provided in its middle section for its interlocking in a C-shaped guide rail with a hammer-shaped head which can be rotated through an axis at right angles to the guide rail by a bolt, the width of said head being smaller and the length of said head being greater than the width of the longitudinal slot formed between the arms angled from the limbs of the guide rail and from a retaining part connected to the slide part to fasten a fastening part supporting the door wing, preferably a hinge arm. Such a support part is known from the German published application DE-OS 43 24 340, reference to which is made for a more detailed description.

Preferably, the slide part is provided with a bearing part penetrating the longitudinal slot in which the retaining part is pivoted around an axis running laterally to the slide part. Such a support part which can be mounted more easily is known from DE 296 02 424.4, reference to which is made for a more detailed presentation of the support part.

One essential feature of the present invention comprises only the upper door wing being supported by the retaining fastening and the lower door wing being guided in vertical guide rails of the side panels by the support parts described in the German published application DE-OS 43 24 340 and in DE 296 02 424.4. To open, the user therefore only needs to pull the lower door wing towards himself using a corresponding door handle so that both door wings are swivelled over the head of the user on opening without protruding substantially from the furniture body.

As appropriate, both the retaining fastening and the lateral guide rails with the support parts can be provided in duplicate, that is connected to both side end sections of the flap or of the two-wing folding flap.

To adapt the spring force to the retaining force acting on the flap or to the force supporting the swivel, in accordance with a preferred embodiment it is provided that the shorter lever arm of the two-armed bent lever can be adjusted in its length. Appropriately, the shorter lever arm is also adjustable or movable in its angle position to the longer lever arm.

On the shorter lever arm an adjustment part can be guided in an adjustable manner which is provided with a borehole to hinge the spring-loaded means.

Appropriately, the shorter lever arm is provided with two oblong holes with the adjustment part enclosing the shorter lever arm in a U shape and pins being held in the limbs of the adjustment part which penetrate the oblong holes and are guided in them. The oblong holes can be inclined towards each other in such a way that the adjustment part on the shorter lever arm is pushed onto a circle arc. This type of movement is appropriate so as not to alter the characteristics of the pneumatic spring.

In accordance with another preferred embodiment it is provided that on the bent lever a rotating eccentric disc is supported which grips into a borehole or an oblong hole of the adjustment part and is provided for its rotation with, for example, a screwdriver with a slot or intersecting slots. The eccentric disc is appropriately held in a force-closed manner with its shaft in a borehole of the bent lever so that it can only be rotated after overcoming a friction force.

The retaining fastening in accordance with the invention can also be used as a closing or opening means for retaining sliding doors pivotable around perpendicular axes. In such an application, the spring-loaded means or the pneumatic spring only needs to exert a lower force as this does not have to hold or overcome the weight of the door.

BRIEF DESCRIPTION OF THE DRAWINGS

One embodiment of the invention is described in more detail below by means of the drawing in which.

DESCRIPTION OF THE PREFERRED EMBODIMENTS

Figure 1:
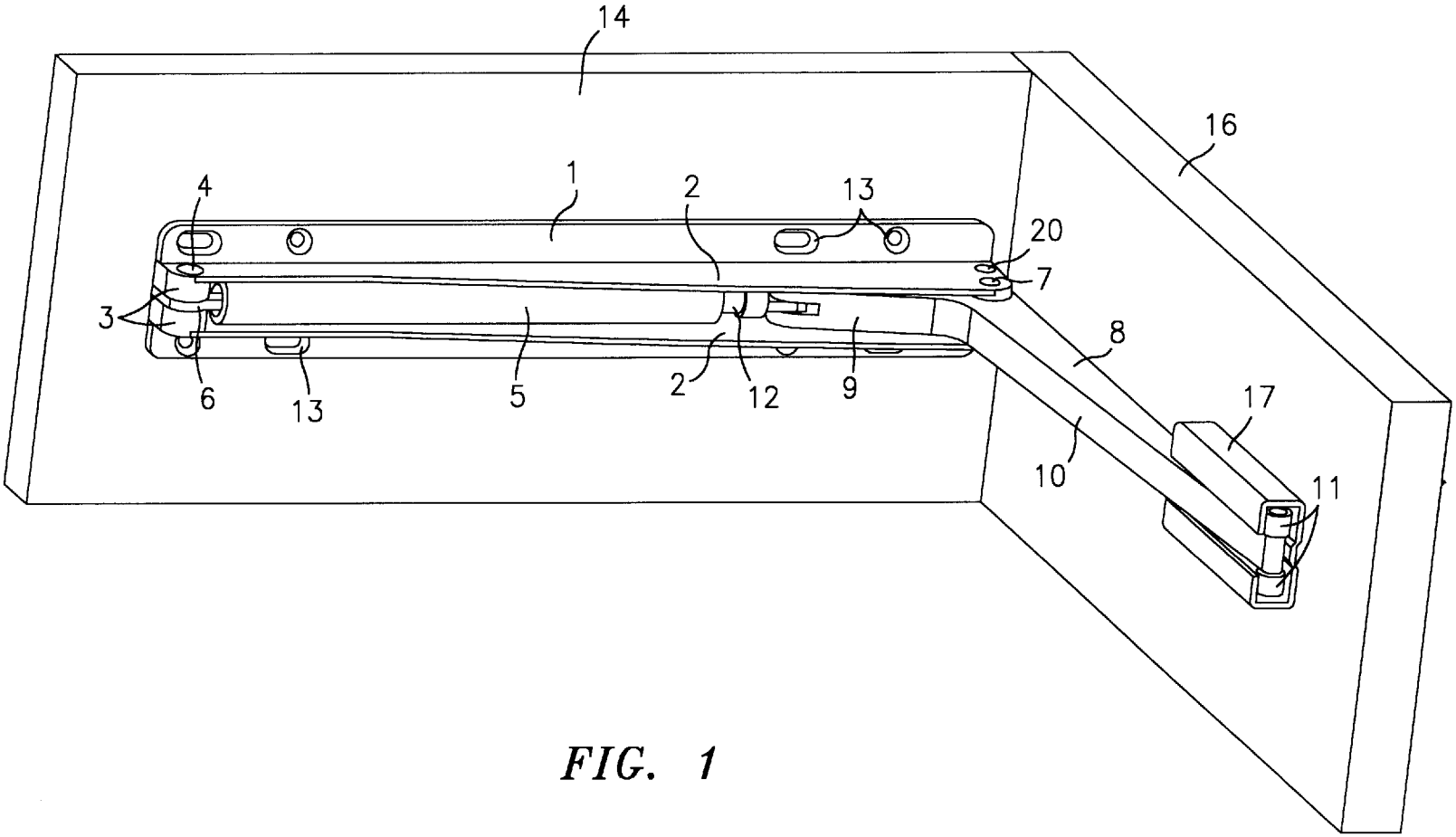
FIG. 1 shows a perspective view of the mounted retaining fastening in the closed state of the furniture flap, FIG. 2 a section through a cupboard closed by a two-wing folding flap with a side view of the retaining fastening and of the retaining part guided in a guide rail fixed on one side panel of the body part, the retaining part being pivotably connected to the lower end section of the lower flap wing, FIG. 3 a section or side view from FIG. 2 in an opened state of the two-wing folding flap, FIG. 4 a top view of the fastening plate for the spring housing and the two-armed bent lever, FIG. 5 a top view of a part of a bent lever formed in two parts in accordance with a second embodiment of the invention, FIG. 6 a top view of the other part of the two-part bent lever, FIG. 7 a cross-section through the bent lever composed of the parts from FIGS. 5 and 6, FIG. 8 a side view of a bent lever with an adjustable shorter lever arm, FIG. 9 the bent lever from FIG. 8 with a removed adjustment part, FIGS. 10 and 11 two views of the adjustment part.

As can be seen from FIG. 1, the retaining fastening comprises an essentially rectangular fastening plate 1 which is connected to two arms or limbs 2 running parallel to each other and being at right angles to said fastening plate 1. In the rear end section the limbs 2 are provided with bushing-like sideways extensions 3 which are penetrated by aligned transverse boreholes 4. In these transverse boreholes a bolt is held on which the rear end of the spring housing 5 is pivoted via an arm 6 provided with a bearing borehole.

In the front end section the limbs 2 are provided with aligned transverse boreholes in which a bearing bolt 7 is held on which a bent lever 8 is pivoted. The bent lever 8 comprises a shorter lever arm 9 and a longer lever arm 10 which is provided on its free end with two rollers 11 supported on a pin penetrating said longer lever arm 10 in a transverse borehole. The shorter lever arm 9 possesses a forked end between whose limbs a bolt is held in aligned boreholes on which bolt the front end of the rod 12 movably guided in the spring housing 5 is supported in a transverse borehole.

The spring-loaded means comprising the spring housing 5 and the rod 12 guided in this can be a pneumatic spring or also a means in which a helical spring is clamped in the spring housing 5 between its bottom and the rod.

The fastening plate is provided on both sides of the limbs 2 with fastening boreholes 13 via which it can be fastened centrally to the top plate 14 of a cupboard or, if necessary, in the vicinity of a side panel by means of fastening screws.

A flap 16 is connected pivotably around a horizontal axis to the top plate 14 by conventional guide/cup hinges 15. On the inside of the flap 16 a C shaped guide rail 17 is fastened in which the rollers 11 of the longer lever arm 10 of the bent lever 8 are guided. The lever arms 9, 10 of the bent lever 8 enclose an oblique angle as can be seen from FIGS. 3 and 7.

The limbs are provided between the boreholes of the limbs 2 for the bearing bolt 7 and the fastening plate with further aligned boreholes 19 in which a bolt 20 is held with an eccentric shaft part 21. The bolt 20 can be turned by means of a screwdriver so that the eccentricity of the shaft 21 can be set. The bolt 20 serves in the manner seen from FIG. 3 as a stop for the bent lever 8 in the open position.

Figure 5:
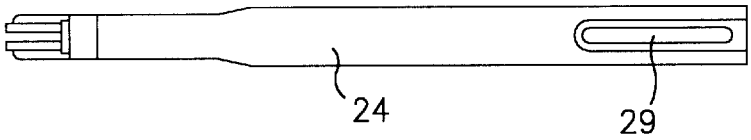
Figure 6:
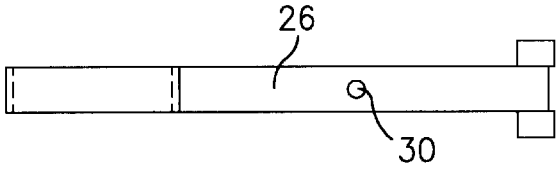
Figure 7:
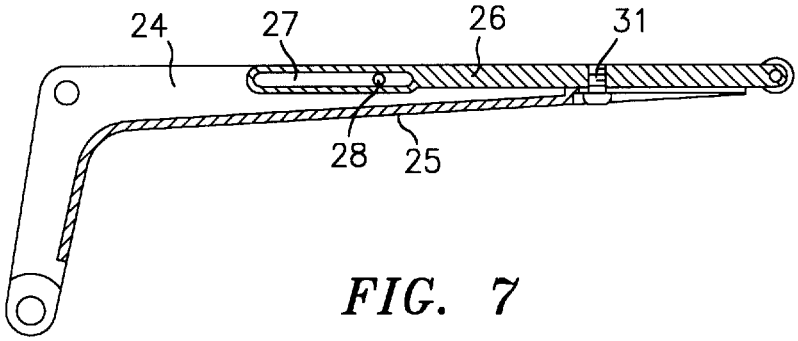

From FIGS. 5 and 7 a bent lever can be seen whose longer arm is formed in an adjustable manner. The base body 24 of the bent lever possesses a U-shaped cross-section. The movable extension part 26 is guided movable between the side limbs of the longer lever arm 25. For this purpose, the extension part 26 possesses an oblong hole 27 penetrated by a pin 28 held in the limbs of the longer arm 25. The longer arm is provided in its front section in its arm part with an oblong hole 29 penetrated by a fixing screw 31 which can be screwed into a tapped hole 30 of the extension part 26 and whose broadened head is supported on the edges of the oblong hole 29.

Figure 2:
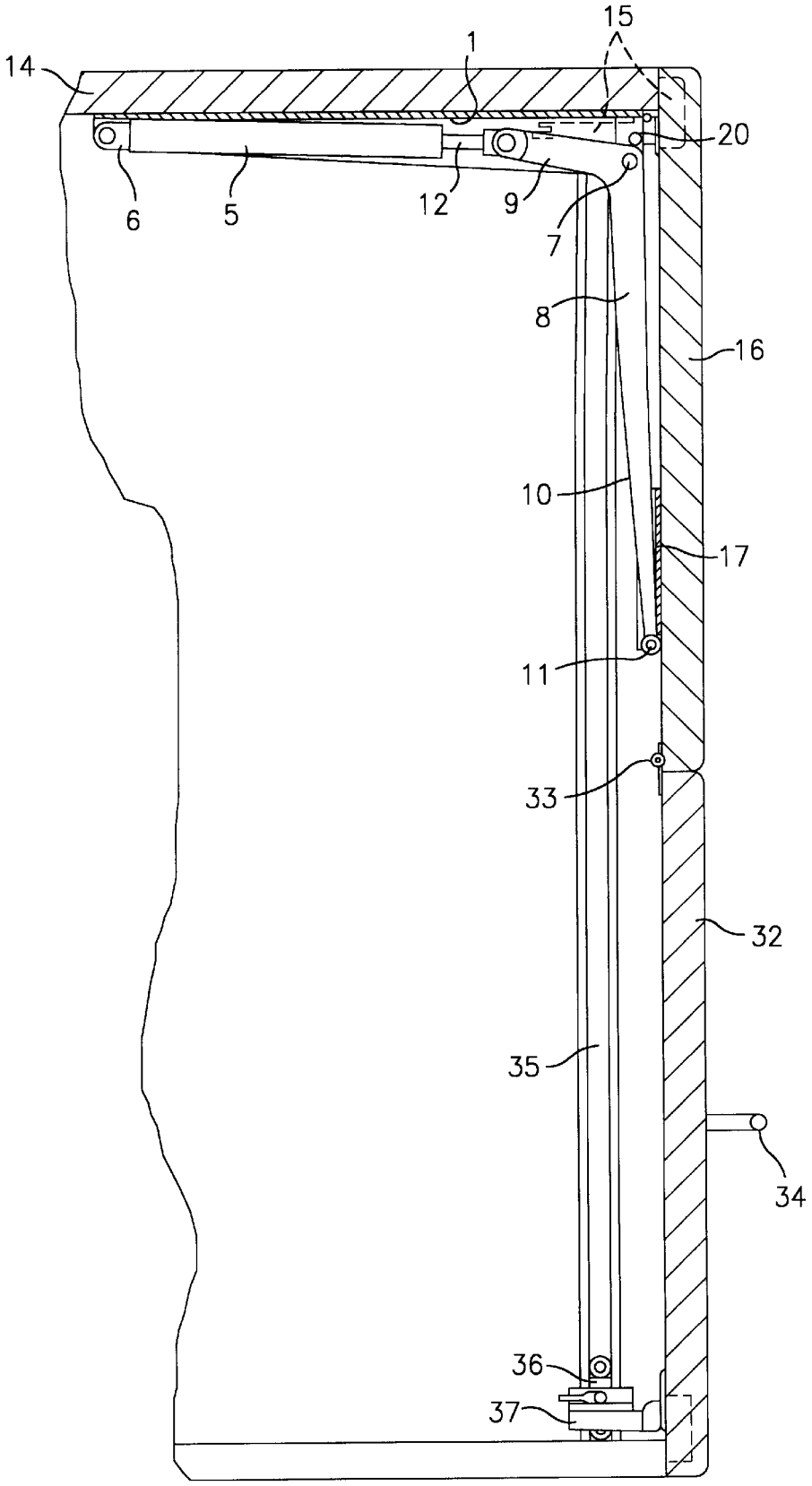
Figure 3:
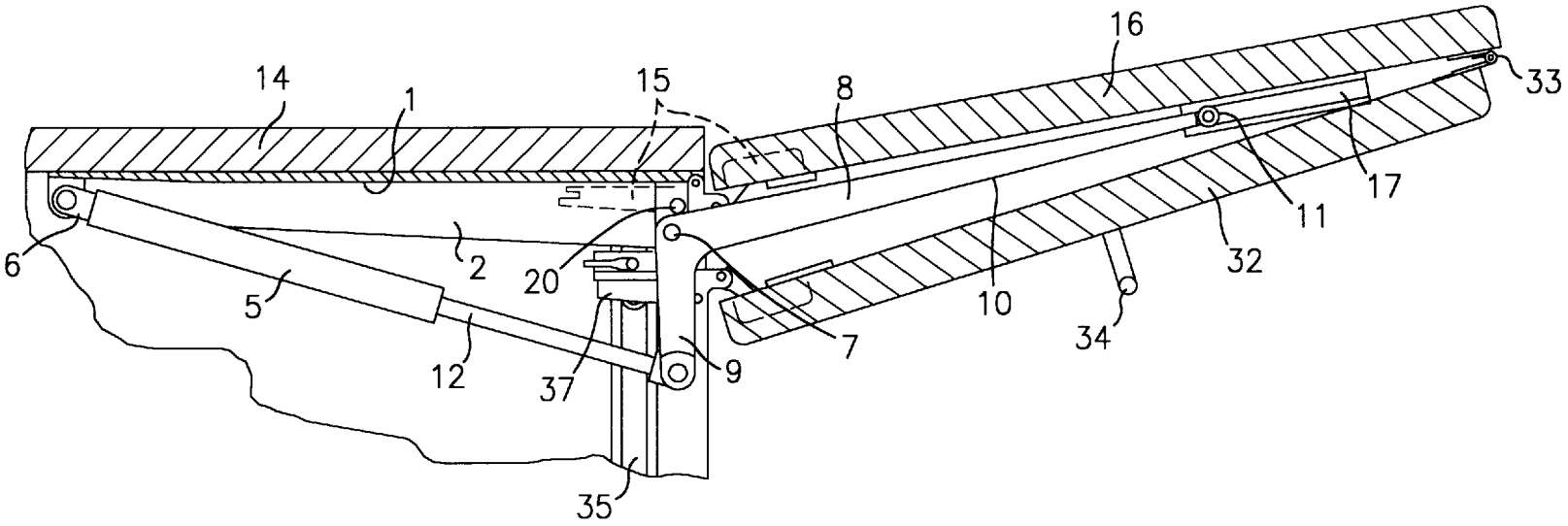
Figure 4:
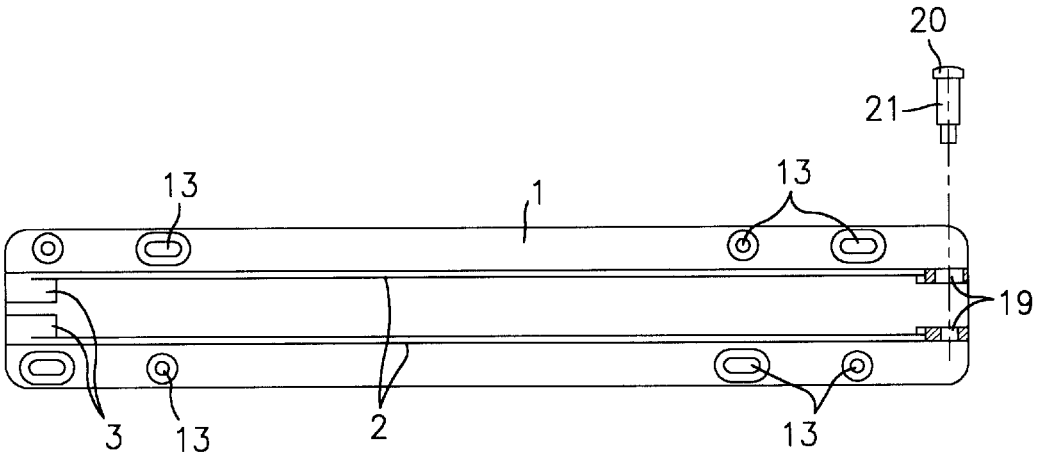

As can be seen from FIGS. 2 and 3, the flap 16 forms the upper wing of a two-wing folding flap whose lower wing 32 is connected to the upper wing 16 by a hinge band 33. The lower wing is provided in its middle section on its outside with a handle 34. At least on one side panel of the cupboard a C-shaped guide rail 35 is fastened parallel to the opening edges in which a support part 36 is movably guided which is connected to the lower edge section of the lower wing by a conventional four-joint, double guide hinge 37. With regard to the more detailed design of the support part 36 and its connection by the hinges 37 to the lower wings and to the design of the guide rails 35 reference is made to DE-OS 43 24 340 and DE 296 02 424.4 and accompanying FIGS. 12–17.

As can be seen from FIG. 2, the spring housing extends into the cupboard interior in the closed state of the flaps with the rod guided movably in it against elastic force roughly parallel to the top panel 14. Due to the oblique angle enclosed by the arms 9, 10 of the bent lever 8 the spring-loaded means exerts a closing moment on the flaps in the closed position.

As can be seen from FIG. 3, the shorter lever arm of the bent lever 8 protrudes in the opened position only insignificantly over the lower wing of the folding flap so that access to the inside of the cupboard is hardly impaired by the lifting retaining fastening in accordance with the invention.

The longer lever arm 10 contacts tightly to the upper wing 16 in both the closed position and the opened position of the folding flap so that it only takes up a little room.

In the completely opened position of the folding flap seen in FIG. 3, the hinges are not overloaded by the bent lever 8 because the longer lever arm is supported in the open position on the stop formed by the transverse pin 20.

The eccentric pin 20 does not form only a stop, but can also be turned for assembly purposes into a position in which the pneumatic spring or spring-loaded means can be mounted when travelled out to its greatest length. After the assembly, the eccentric bolt is turned into a position in which the bent lever is supported on it with bias.

To mount the retaining fastening in accordance with the invention, the fastening plate 1 is first fastened to the inside of the top plate. The fastening plate can be moved via the oblong holes for vertical adjustment. The bent lever is appropriately already supported between the limbs of the fastening plate. Subsequently, the pneumatic spring or the spring-loaded means is mounted in the extended position. After the assembly, the longer lever arm of the bent lever is rotated manually through a small angle into the closed position and the bolt 20 is turned through a small angle into a position in which the longer lever arm is supported on this under spring force. The upper door wing is appropriately hinged to the top panel by conventional hinges, preferably so-called clip-hinges. The lower door hinge is then connected in a known manner to the support part. The bent lever 40 visible in FIG. 8 comprises a base body 41 made in one piece visible in FIG. 9. This base body can be stamped out of a fairly thick metal sheet or comprise a package of thinner metal sheets which are then riveted together to form a base body. The longer lever arm is provided with a bead 42 for reinforcement.

An adjustment part 43 is movably guided on the base body 41. The adjustment part 43 comprises a U-shaped, bent middle part 44 with which it encloses the shorter lever arm 45 of the base body 41. The shorter lever arm 45 is provided in the manner visible in FIG. 9 with two oblong holes 46 positioned in inclination to one another. In the limbs 47, 48 of the middle part 44 two pins are riveted in aligned boreholes 49 which pins penetrate the oblong holes 46.

The adjustment part 43 possesses on its free forked end aligned boreholes 50 to hinge the piston rod of the pneumatic spring. The limb 48 of the adjustment part 43 is extended and provided with an oblong hole 51. In this oblong hole 51 a circular disc-shaped eccentric 52 provided with intersecting slots engages whose eccentric shaft is riveted in a borehole 53 of the longer lever arm in such a way that it is held in it with friction force, but rotatably. The oblong holes 46 are inclined to each other in such a way that the adjustment part 43 is moved when the eccentric 42 is turned once roughly on the dotted circle line 54 in FIG. 8.

Figure 8:
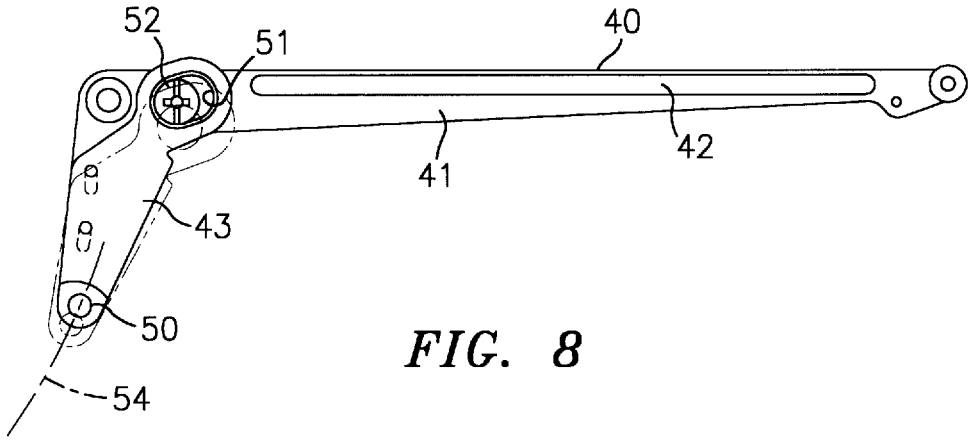
Figure 9:
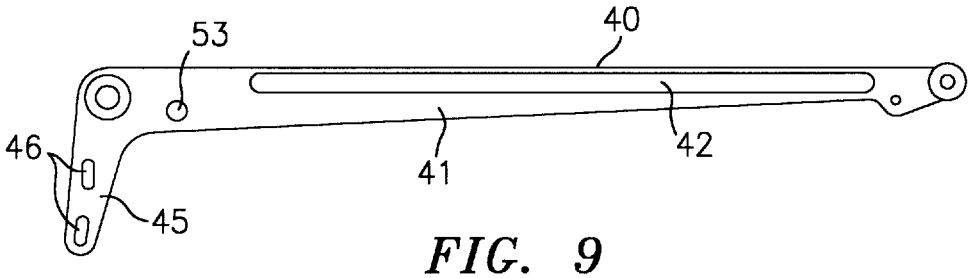
Figure 10:
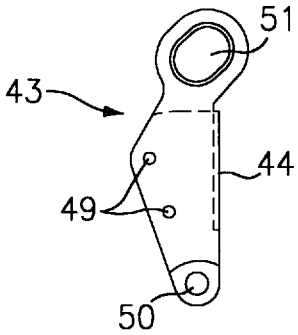
Figure 11:
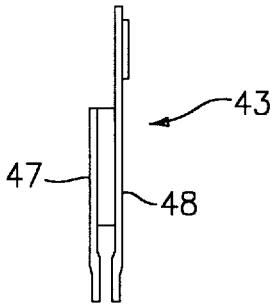
Figure 12:
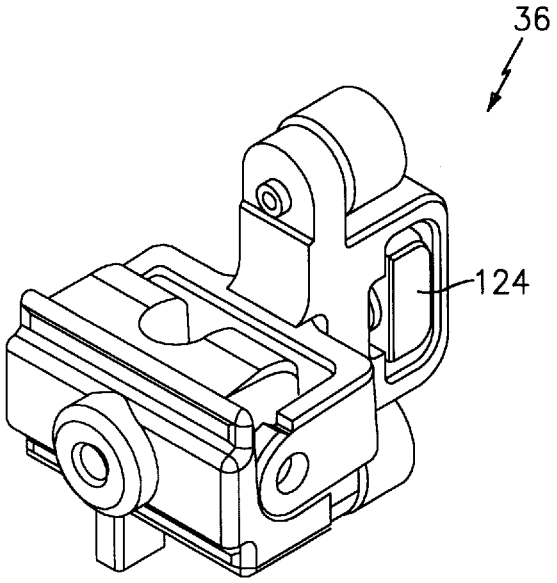
FIGS. 12–14 are schematic perspective views illustrating preferred features of a support for the furniture flap.
Figure 13:
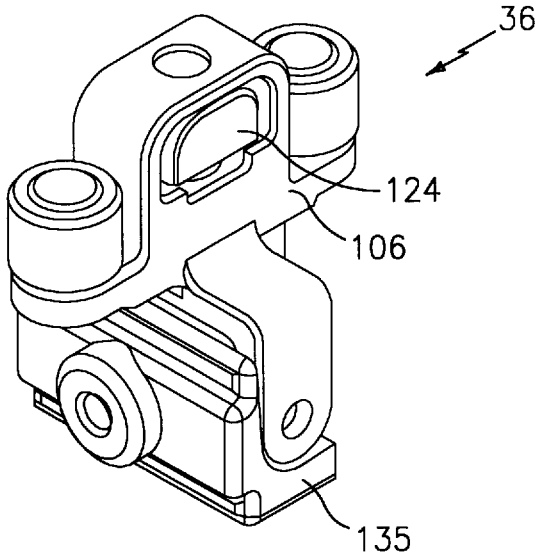
Figure 14:
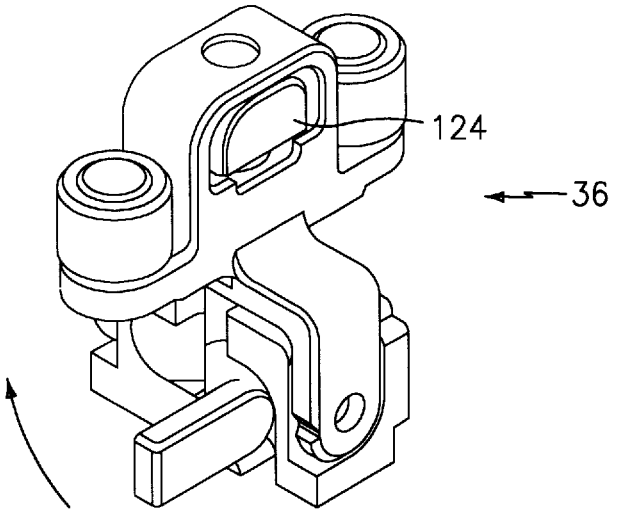
Figure 15:
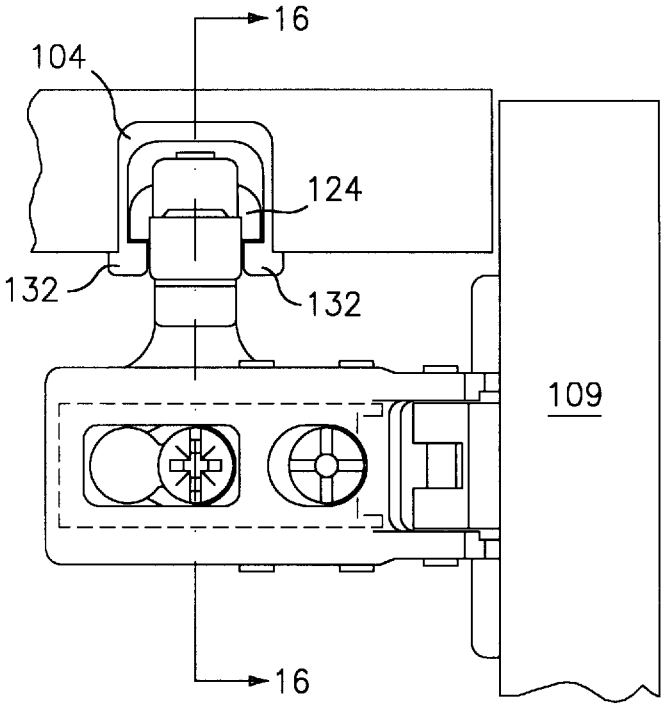
FIG. 15, is a side elevational view of the support illustrated in FIGS. 12–14 as mounted upon the flap.
Figure 16:
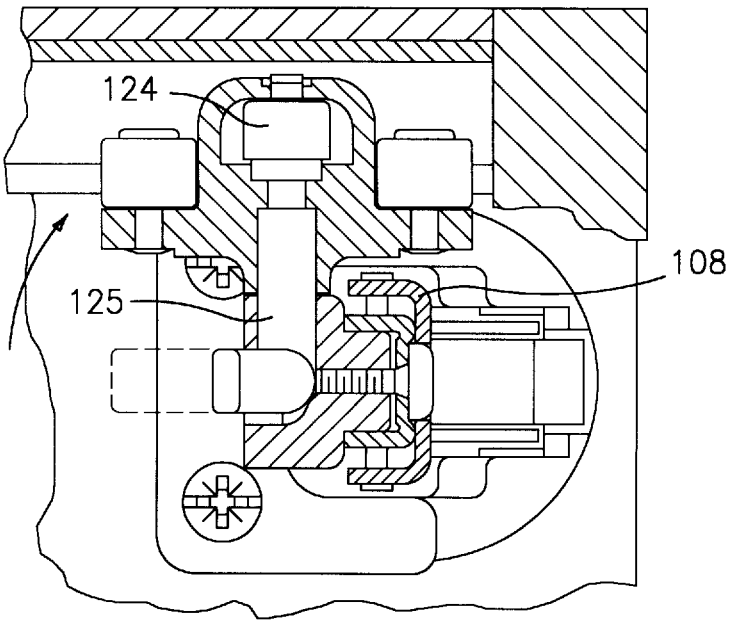
FIG. 16 a sectional view along line 16—16 in FIG. 15.
Figure 17:
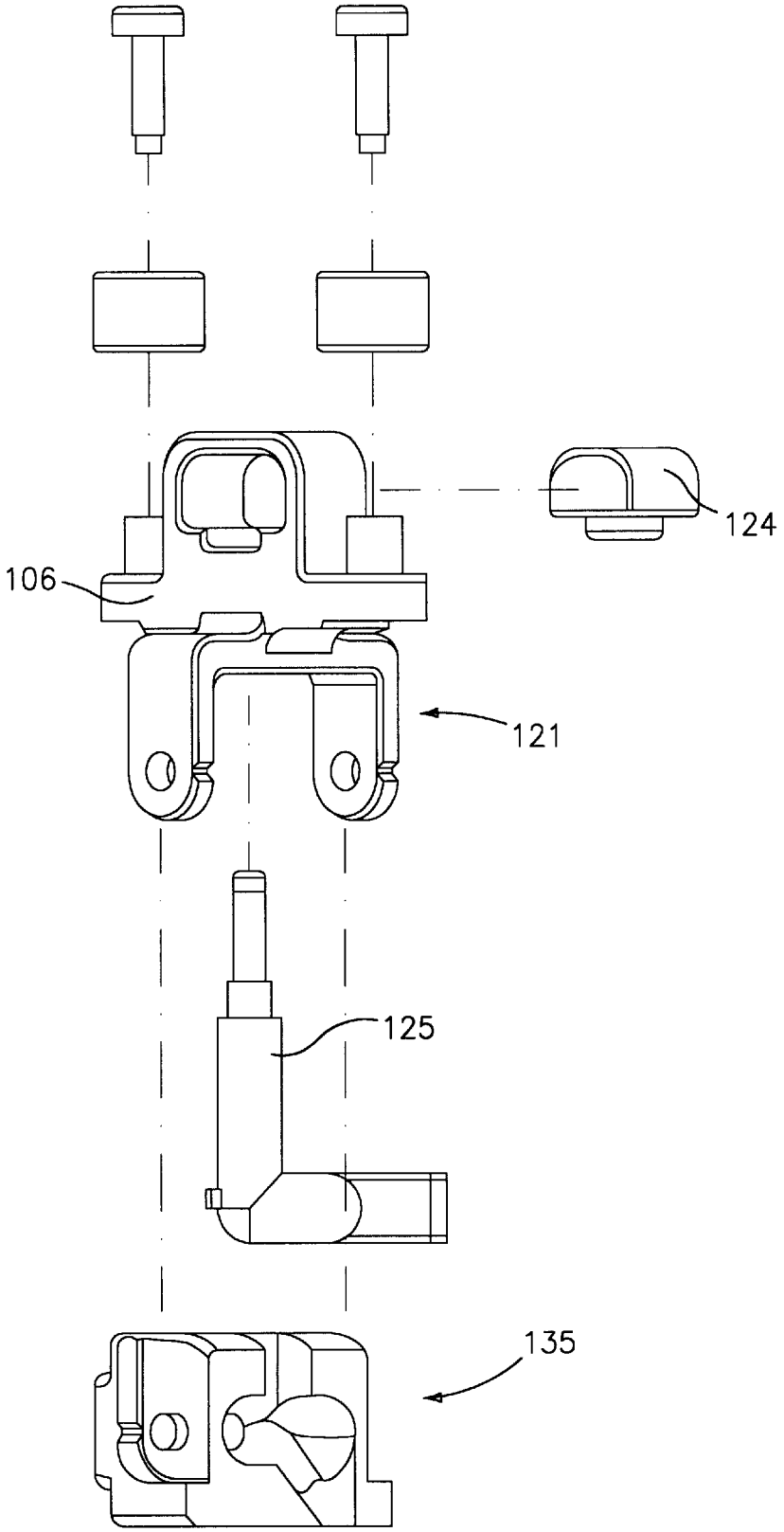
FIG. 17 is an exploded view of the flap support shown in FIGS. 12–16.

The adjustment part is shown in FIG. 8 in its extended position in dotted lines.

As illustrated in FIGS. 12–17, the support part 36 may comprise an elongated slide part 106 which is provided, in its middle section for interlocking in a C-shaped guide rail 104, with a hammer-shaped head 124 which can be rotated through an axis at right angles to the guide rail 104 by a bolt 125. A width of the head 124 is smaller, and a length of the head 124 is greater, than width of a longitudinal slot formed between arms angled from limbs 132 of the guide rail 104. Further, a retaining part 135 is connected to the slide part 106 to fasten a fastening part, preferably a hinge arm 108, supporting a door wing 109. In this regard, the slide part 106 can be provided with a bearing part 121 penetrating the longitudinal slot in which the bearing part 121 is pivoted around an axis extending laterally to the slide part 106.

I claim:

1. A retaining fastening comprising a lever pivotably connectable to a body part of a cupboard, a free end of said lever being guided in a rail which can be fastened to an inside of a flap at a right angle to a swivel axis of the flap, and said lever pressurized by spring-loaded means, wherein said lever comprises a two-armed bent lever (8) having a longer arm (10) and a shorter arm (9) and whose swivel axis (7) lies between the lever arms (9, 10), with the longer lever arm (10) being guided in the rail (17) and on the shorter lever arm (9), extending in a closed state of the flap (16, 32) to an inside of the cupboard, one end of the spring-loaded means (5, 12) is hinged with another end of the spring-load means (5, 12) being pivotably linked to the body part, and the bent lever (8) and a housing (5) for the spring-loaded means (5, 12) are pivoted between protruding limbs (2) of a fastening plate (1) which can be attached to a top panel of the cupboard.

2. A retaining fastening in accordance with claim 1, wherein the two lever arms (9, 10) form an oblique angle and a line of action of spring force extends above the swivel axis (7) of bent lever (8) with the flap (16, 32) closed.

3. A retaining fastening in accordance with claim 2, wherein the longer lever arm (10) can be adjusted in length.

4. A retaining fastening in accordance with claim 1, wherein the longer lever arm (10) can be adjusted in its length.

5. A retaining fastening in accordance with claim 1, wherein a detent pin (20) for the bent lever (8) is held between the limbs (2) above the swivel axis (7) of the bent lever (8).

6. A retaining fastening in accordance with claim 5, wherein the detent pin (20) is pivoted and possesses an eccentric shaft (21).

7. A retaining fastening in accordance with claim 1, wherein said fastening is structured and arranged to be attached to the flap (16) which is an upper wing of a two-wing folding flap (16, 32) having a lower wing (32) hinged to a support part (36) which is guided in a guide rail hinged in a side panel of the body part.

8. A retaining fastening in accordance with claim 7, wherein the support part comprises an elongated slide part which is provided in a middle section thereof for interlocking in a C-shaped guide rail, with a hammer-shaped head which can be rotated through an axis at right angles to the guide rail by a bolt, a width of said head being smaller and a length of said head being greater than width of a longitudinal slot formed between arms angled from limbs of the guide rail, and a retaining part connected to the slide part to fasten a fastening part supporting a door wing.

9. A retaining fastening in accordance with claim 8, wherein the slide part is provided with a bearing part penetrating the longitudinal slot in which the bearing part is pivoted around an axis extending laterally to the slide part.

10. A retaining fastening in accordance with claim 8, wherein the fastening part is constituted by a hinge arm (108).

11. A retaining fastening in accordance with claim 1, wherein the shorter lever arm of the two-armed bent lever can be adjusted in length.

12. A retaining fastening in accordance with claim 11, wherein the shorter lever arm of the two-armed bent lever can be adjusted in its angle position to the longer lever arm.

13. A retaining fastening in accordance with claim 11, wherein on the shorter lever arm (45), an adjustment part (43) is movably guided which is provided with a borehole (50) for hinging of the spring-loaded means (5).

14. A retaining fastening in accordance with claim 13, wherein the shorter lever arm (45) is provided with two oblong holes (46), the adjustment part (43) encloses the shorter lever arm (45) in a U shape and pins are held in the limbs (47, 48) of the adjustment part (43) which penetrate and are guided in the oblong holes (46).

15. A retaining fastening in accordance with claim 14, wherein the oblong holes (46) are inclined towards each other in such a way that the adjustment part (43) is pushed onto the shorter lever arm (45) on a circle arc (54).

16. An adjustment part in accordance with claim 13, wherein on the bent lever a pivotable eccentric disc (52) is supported which engages a borehole or an oblong hole (51) of the adjustment part (43) and which is provided for turning with a slot or intersecting slots.

17. A retaining fastening in accordance with claim 1, wherein said fastening is structured and arranged to be fastened to the flap which is hinged around a vertical swivel axis to the body part of the cupboard.

18. A retaining fastening in accordance with claim 1, wherein said spring-loaded means comprise a rod which can extend into and out of the spring housing by means of pneumatic or elastic force.

19. A retaining fastening comprising a lever pivotally connectable to a body part of a cupboard, a free end of said lever being guided in a rail which can be fastened to an inside of a flap at a right angle to a swivel axis of the flap, and said lever pressurized by spring-loaded means, wherein said lever comprises a two-armed bent lever (8) having a longer arm (10) and a shorter arm (9) and whose swivel axis (7) lies between the lever arms (9, 10) with the longer arm (10) being guided in the rail (17) and on the shorter lever arm (9), extending in a closed state of the flap (16, 32) to an inside of the cupboard, one end of the spring-loaded means (5, 12) is hinged, with another end of the spring-loaded means (5, 12) being pivotably linked to the body part, and a detent pin (20) for the bent lever (8) is held between limbs (2) of a fastening plate above the swivel axis (7) of the bent lever (8).

20. A retaining fastening comprising a lever pivotally connectable to a body part of a cupboard, a free end of said lever being guided in a rail which can be fastened to an inside of a flap at a right angle to a swivel axis of the flap, and said lever pressurized by spring-loaded means, wherein said lever comprises a two-armed bent lever (8) having a longer arm (10) and a shorter arm (9) and whose swivel axis (7) lies between the lever arms (9, 10), with the longer lever arm (10) being guided in the rail (17) and on the shorter lever arm (9), extending in a closed state of the flap (16, 32) to an inside of the cupboard, one end of the spring-loaded means (5, 12) is hinged with another end of the spring-load means (5, 12) being pivotally linked to the body part, the shorter lever arm (9) of the two-armed bent lever (8) being adjustable in length, and the shorter lever arm (9) of the two-armed bent lever (8) can be adjusted in its angle position to the longer lever arm (10).

21. A retaining fastening comprising:

a lever pivotally connectable to a body part of a cupboard, a free end of said lever being guided in a rail which can be fastened to an inside of a flap at a right angle to a swivel axis of the flap, and said lever pressurized by spring-loaded means, wherein said lever comprises a two-armed bent lever (8) having a longer arm (10) and a shorter arm (9) and whose swivel axis (7) lies between the lever arms (9, 10), with the longer lever arm (10) being guided in the rail (17) and on the shorter lever arm (9), extending in a closed state of the flap (16, 32) to an inside of the cupboard, one end of the spring-loaded means (5, 12) is hinged with another end of the spring-load means (5, 12) being pivotally linked to the body part, the shorter lever arm (9) of the two-armed bent lever (8) being adjustable in length, wherein on the shorter lever arm (45), an adjustment part (43) is movably guided and which is provided with a borehole (50) for hinging of the spring-loaded means (5).

* * * * *